United States Patent [19]

Reil

[11] Patent Number: 4,604,850

[45] Date of Patent: Aug. 12, 1986

[54] PACK FOR FLUID FILLING MATERIALS WITH RECLOSABLE OPENING DEVICE

[75] Inventor: Wilhelm Reil, Bensheim, Fed. Rep. of Germany

[73] Assignee: Tetra Pak Developpement S.A., Pully, Switzerland

[21] Appl. No.: 631,152

[22] Filed: Jul. 17, 1984

Related U.S. Application Data

[62] Division of Ser. No. 319,907, Nov. 10, 1981, abandoned.

[30] Foreign Application Priority Data

Nov. 15, 1980 [DE] Fed. Rep. of Germany ..... 3043134

[51] Int. Cl.[4] ..... B65B 3/04

[52] U.S. Cl. ..... 53/423; 53/452; 53/456; 53/561; 53/563; 493/61; 493/85; 493/87; 493/302

[58] Field of Search ..... 53/423, 456, 452, 561, 53/563, 272; 493/59, 60, 61, 302, 293, 85, 339, 338, 160, 161, 87

[56] References Cited

U.S. PATENT DOCUMENTS

| | | | |
|---|---|---|---|
| 2,056,093 | 9/1936 | Claff | 493/160 X |
| 2,061,967 | 11/1936 | Meyer-Jagenberg | 493/160 |
| 2,070,838 | 2/1937 | Örström | 493/157 X |
| 2,201,177 | 5/1940 | Hothersall | 493/156 X |
| 3,234,858 | 2/1966 | Rein et al. | 493/102 X |
| 3,823,850 | 7/1974 | Holoubek et al. | 493/157 X |
| 4,074,961 | 2/1978 | Reil | 425/112 |
| 4,079,664 | 3/1978 | Jones | 493/156 |
| 4,208,852 | 6/1980 | Rioch | 53/561 X |

FOREIGN PATENT DOCUMENTS

| | | |
|---|---|---|
| 1091850 | 10/1960 | Fed. Rep. of Germany . |
| 2210013 | 7/1973 | Fed. Rep. of Germany . |

*Primary Examiner*—James F. Coan

*Attorney, Agent, or Firm*—Howard M. Ellis; Michael L. Dunn

[57] ABSTRACT

Two-piece containers having a one-piece tubular body and base and a cover molded onto the body are formed from a continuous web of thermoplastic supporting material by means of an apparatus which includes tube forming, cover molding, container filling and container base sealing stations. The web of material is initially formed into a strand of partially assembled tubular container bodies having fold impressions for the base and then severed into separate tubular bodies for further processing, filling and sealing.

22 Claims, 8 Drawing Figures

PACK FOR FLUID FILLING MATERIALS WITH RECLOSABLE OPENING DEVICE

Figure 1:
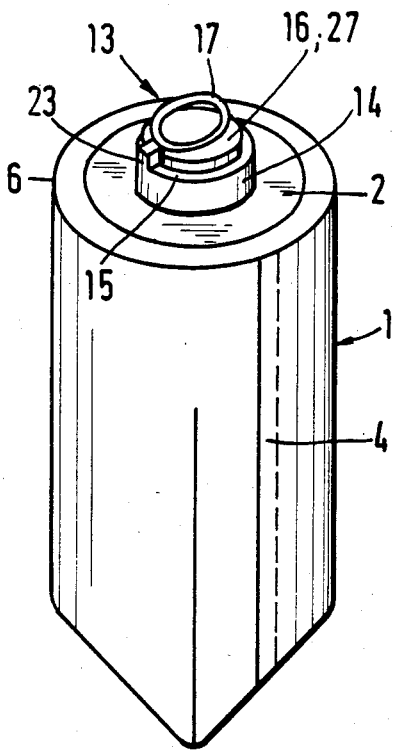

This is a division of application Ser. No. 319,907, filed Nov. 10, 1981, and now abandoned.

The invention relates to a pack for fluid filling materials, comprising side walls which are joined together to form a tube by at least one longitudinal sealing seam, and end walls which are mounted at the ends of the tube and which form the bottom and cover of the pack, one end wall being made of thermo-plastic material without any supporting material, being moulded onto the side walls along its outer edge and having a pouring device which is pushed inwards inside the outer contour of the pack, wherein the side walls are made of supporting material, e.g. carton, which is coated with thermo-plastic material at least on one side.

The type of pack which nowadays has proved to be most successful for transporting liquids, particularly milk and fruit juices, is a parallelepipedal pack, comprising a tube of supporting material which is coated on both sides with plastics, sealed by transverse ribs at the ends in the region of the end walls and brought into a parallelepipedal shape, so that two opposed, double-walled triangular flaps are formed at each end wall, the flaps initially projecting outwardly from the end walls of the pack and finally being folded over onto adjacent side walls or the end walls of the pack.

Many packs of this type are used, even for powdered and granular type filling materials. In some known packs the pouring aperture is formed by punching lines of perforation or other lines of weakness in the outer layer of the pack; the lines are then torn when the appropriate triangular flap has been unfolded. An opening already punched out of the pack material and covered by a fluid-tight strip is also known. The covering strip is taken hold of and pulled upwards by means of a free gripping portion not fixed to the side wall, and the tear-open aperture, located on the inside of the triangular flap, is then exposed in the form of a round or elongated hole. A disadvantage of this known pack is that the filling material is not poured out in the desired jet, which would avoid spilling.

In another type of pack an attempt has been made to provide a rectangular slot, covered with a sealing strip, as the pouring aperture, this being located at one side of the end wall adjacent the transverse seam. However, the sealing on of a cover strip quite commonly creates problems (a) of sealing and (b) of ease in tearing off. Similar problems arise when the pouring aperture, which has first been punched out and then sealed with a cover strip, is located in the upper wall of the triangular flap. Various different opening devices have therefore been developed, in the field of parallelepipedal packs alone, where the transverse seam sealing the end wall is itself ripped open over a certain width, or where tearing aids are used, such as threads which are welded in.

Particularly since petroleum has become expensive, it has been imperative for the manufacturers of packs for fluid materials that they should use as little plastics as possible, particularly for coating the support material, and that the machine for manufacturing the pack should be of the simplest possible construction, if possible without using a cover strip which has to be sealed on from inside and possibly even separately from outside. Time and time again compromises have had to be made between the reliability of the seal on the one hand and ease in opening on the other.

In a liquid pack known from DE-OS No. 2 210 013 the side walls are similarly made of carton coated with thermo-plastic plastics, but the cover and base are made of thermo-plastic plastics without any carrying material. In the "ready to fill" state the pack is constructed with the cover moulded onto the side walls along its far edges, but with the base moulded on only along one edge for the purpose of filling the pack. A pack of this type is cheap to produce, of a practical construction and reliable in use. Like the most widely used and best known parallelepipedal liquid pack, this known pack has an exact shape with good stability and the possibility of shrinkage when bundled together.

The pack known from this publication so to speak stands on its head for filling; for the cover, which is integral with the opening device, is initially at the bottom, while the blase, which is moulded on only along one side edge, is located at the top adjacent the open tube of the pack ready for filling. The manufacture of such an opening device does not require any complex injection moulds for moulding on the thermo-plastic end walls, as the tools can easily be pushed or pulled out of the tube.

After the filling process the known pack is sealed at what will subsequently be its base. Here difficulties may sometimes arise in centering and welding with exact imperviousness, or at least the outlay on machinery for welding the end wall forming the base is not insignificant, although the main centering operation has already been carried out in folding the base onto a side wall.

The invention therefore aims to provide a pack of the above type. It must be possible to manufacture a stable pack which has good impervious properties, with optimum economy in material, and the pack must be easily opened and reclosed by the final consumer without any special instructions. The invention also aims to provide a method of making such a pack and an apparatus for carrying out the method.

As a means of achieving this aim, the new pack according to the invention is characterised in that the end wall made only of thermo-plastic material forms the cover, and the end wall forming the base is square and has a transverse sealing seam with triangular flaps which are folded over onto an adjacent wall. Here a fluid pack, with an unaccustomed combination of completely different closures at the end walls, is provided for the first time. In contrast with the known pack last described, only the end wall forming the cover is to be made of pure thermo-plastic plastics; the base on the other hand, as in conventional packs, is to be sealed by a transverse seam and shaped in known manner, by folding over the triangular flaps, into one of the usual end wall configurations, the opening of which always created difficulties in the past.

This combination of the two completely different systems for making end walls is in no way obvious, since there are no production machines which promise any solution to the problem posed above if such a principle were applied.

With the new principle according to the invention, of making one end wall as a pure plastic cover and the base in the conventional square form, fluid packs can be made in cube, parallelepipedal or other shapes. For example, it is desirable according to the invention for the cover and the cross-section of the pack at least in the region of the cover to be round, and for the shape of the cover during and immediately after the moulding process to be the utilisation shape. This last feature means that the cover, made exclusively of thermo-plastic plastics, is moulded in the shape in which it will be utilised. Thus it will be in the utilisation form, i.e. the form in which the final consumer opens the pack, pours out the filling material and possibly recloses the pack, obviously during the moulding operation and also up to the next stage in the process, which may e.g. involve deformation of the cover. The advantage of this measure is that thermo-plastic plastics generally tend to return to the shape in which they were moulded, after undergoing any deformation. In contrast with this, in the known packs the end walls, which may form the cover with an opening device, are moulded as an entity so that the transporting shape is immediately obtained. After being filled and sealed the pack can then be put into a bundle at once and transported away. However it has been found, particularly with packs in the household, that a cover thus moulded is difficult to open. It is far easier and more pleasant e.g. for the housewife to bring an opening device from a deformed shape into the shape in which it was moulded by pushing or pulling. In the present case the cover moulded onto the side walls has its opening device pushed in, so that the outside contour is not troubled by projecting parts of the opening device, immediately before and then after filling and during transportation. Before using the opening device in the cover, the final consumer therefore has to pull it out, and this very process is greatly facilitated since the thermo-plastic material in any case tends to return to the shape in which it was moulded.

The round cover and the round construction of the cross-section of the pack in the region of the cover enables particularly simple tools to be used, and yet the pack nevertheless still has the advantages of stability, good space utilisation, the ability to fit together in bundles and imperviousness.

According to the invention it is further advantageous for the pouring device to have an upwardly and outwardly projecting annular collar, the upper edge of which is joined to a stopper with a gripping ring welded onto it and is located within the outer contour of the pack for transportation. Even in the form in which it is moulded, the gripping ring projects somewhat from the stopper, so that the user can easily take hold of it, use it to pull the pouring device up into the utilisation shape, and open the aperture by pulling off the stopper along the top edge of the collar. Before such opening the gripping ring preferably projects, turned laterally through 180° from the stopper.

With a special pack shape it may be desirable for an arched portion extending away from the collar to be provided in the stopper at the place where the gripping ring is joined to it, and for its hinge to be moulded onto the diametrically opposed side of the stopper. When the gripping ring is pulled up and the utilisation shape reached, the arched portion enables a first small air inlet to form, thus also facilitating opening, i.e. the pulling of the stopper from along the upper edge of the collar. On one side of the top edge of the collar there is thus the weakened portion to be severed and to form the air inlet, while on the diametrically opposed side a thickened portion is provided; this prevents the stopper from being pulled right off even if it is raised carelessly, so the stopper remains on the thickened portion and is connected as around a hinge.

In the method of making the pack, the coated supporting material is first pre-corrugated, fed from a coil in web form to bending and folding stations, and pulled against an outer ring under tension to form a tube. Only then is the tube closed by longitudinal sealing. There are already some development proposals for making a tube which will later be closed by longitudinal sealing, by taking a web of material which has been impressed and cut to a suitable size, and guiding the material through an outer ring, so as to form the tube, at a tension such that the web of material is applied to the ring and thus takes on a circular cross-section. If these development proposals are used to solve the problem of the invention, then the tube is desirably drawn onto a jig mandrel. Longitudinal sealing takes place, according to the invention, between the mandrel and outer jaws. One length of tube each time is pulled off the mandrel in time with the machine, transferred to a lower moulding tool component and moved laterally out of the advancing direction, into position relative to an upper tool component. The cover is moulded, thereby joining it to the end of the length of tubing, and cooled. The length of tubing, sealed at one end, is then pulled off the lower moulding tool. When the cover has finally been pressed into the transporting shape the pack, after being filled, is sealed at the base by block base welding.

Whereas in the prior arrangements the web for forming the tube is pulled against an outer ring from inside and thereby given a circular shape in cross-section, the invention additionally provides—through the above features—for the tube thus being formed to be pulled onto a jig mandrel. Owing to the special nature of the new pack, with the two different types of closure at the end walls of the length of tube (corresponding to a pack), filling takes place later, so that the space in the tube is available for the jig mandrel. The formation of the longitudinal sealing seam takes place intermittently between the mandrel and one or more outer jaws, so that the tube requiring a longitudinal seal is arranged between the mandrel and the jaws. For further processing, including dividing the tube in the web into individual lengths, the tube is pulled off the mandrel and transferred to a different mandrel, which is also constructed as a lower component of the moulding tool. To increase processing speed, the length of tube separated from the web is moved out of the advancing direction and into the moulding machine, where the end wall forming the cover is moulded onto the still open edge of the length of tube. This moulding method is well known in the art, and a good bond between the thermo-plastic material of the cover and the plastic coated side walls, and hence a satisfactory seal, are thus obtained. The newly moulded cover, arranged in its utilisation shape, is now cooled, after which the length of tube is pulled off the lower moulding tool. This preferably happens over a conveyor, in a position such that when the length of tube has been pulled down off the lower mould component and when the now cooled cover has been placed on the conveyor, the cover is immediately pressed in into its transporting shape. In other words, once the cover has been pressed in, the opening means, which are moulded and shaped integrally with the cover, no longer project beyond the overall outside contour of the pack. At the same time the new pack, sealed at the cover and with the cover standing on the conveyor, i.e. so as to speak upside down, stands with its base open to be conveyed further for filling and subsequent sealing. Sealing is effected by welding along the transverse seam in known manner, in the same way as a block base is welded, to form the end wall which shapes the base.

The advantage of the method of the invention as compared with the manufacture of the known pack with the two end walls made only of thermo-plastic material, is that sealing after filling is simpler. Whereas in the known case the welding of the three free edges of the end wall forming the base is difficult, partly because the machine components have to engage the pack exactly and the individual tools need to be made and to move very accurately, and whereas the space inside the pack, above the filling level, is very confined to provide correct engagement for the machine components and welding jaws, and nevertheless too much air space needs to be left in this part of the pack adjacent the filling material, the measures according to the invention provide far better conditions and more space. Although the liquid level or the upper level of the pouring material inserted can be taken to a desired upper edge, the level of fluid material is far enough away from the weld to ensure that no filling material will come between the tools or between the surfaces to be welded during cross sealing. In accordance with the block base forming operation, the sides are folded together at the edge of the tube in question without making any contact with the filling material, so that after the folding process the welded seam can be applied without any problems. When the transverse seam has been cooled, the triangular flaps are then folded over in known manner and welded to an adjacent wall, preferably the actual end wall which forms the base. For the purpose of forming the block base and then welding it, the cross-section of the pack in the region of the end wall which will later form the base must clearly be rectangular.

On the other hand it is very advantageous, as mentioned above in connection with the description of the pack itself, for the end wall which will later form the cover and the adjacent cross-section of the tube to be given a round shape. If the greater part of the tube cross-section is round, as seen e.g. in the direction of the longitudinal seam or in the direction of the tube, a maximum filling volume can be obtained relative to the packing material used. Optimum stability is also obtained, so that the thickness of the supporting material and/or that of the plastic coating on the web of material can be reduced even as compared with the known parallelepipedal packs, without stability suffering.

Further according to the invention, the axis of the tube is advantageously provided in the conveying direction. It is of course quite conceivable and even common practice for the axis of the tube to be arranged transversely to the conveying direction. However, the manufacture of the pack by the new process of the invention allows a higher manufacturing speed to be obtained, with less relative movements between the lengths of tubing from one working station to the next, if the axis of the tube is in the conveying direction. Experiments with the apparatus of the invention have shown special advantages can be obtained if the coiled web of paper is pre-impressed and of a width such that two or even three pack blanks could be made from it side by side, if only two or three pieces of apparatus could be arranged adjacent one another to carry out the method. This is quite possible and even desirable, although one should work from one reel of paper or coil web, since the web is pulled through roller-shaped severing knives, so that each of the two or three adjacent production means is charged with a web of the appropriate width for the pack blank. In this way a machine comprising two of the apparatuses described below, adjacent one another, can have an output of e.g. 3,600 packs per hour.

According to the invention, the apparatus for carrying out the method described above is characterised in that a jig mandrel is provided coaxially and in alignment with an outer moulding ring, a movable longitudinal sealing jaw being provided adjacent the mandrel; that a transporting jaw, oscillating in the conveying direction in time with the machine, is provided downstream of the sealing jaw, and a cutter is arranged downstream of the mandrel, with a rotatable mandrel wheel, with at least three radially projecting mandrel-shaped lower moulding tool components arranged beside the cutter; that a moulding means with an upper moulding tool component is mounted at an angular spacing from the axis of the jig mandrel, and that a conveyor with open-topped shape carriers at a distance a from one another, and also a filling station and a sealing station are provided under the wheel. The apparatus built up in this way can be set up in a relatively confined space; for all the impressing, cutting and longitudinal sealing stations may be arranged in front of or behind direction changing rollers, so that the jig mandrel can be located adjacent the mandrel wheel in the desired position, e.g. at an inclination of 45° to the horizontal, yet can be charged without difficulty in the desired conveying direction. In a desirable embodiment of the invention one or two pairs of rollers in the form of circular knives are provided between the coil of web and the jig mandrel, to divide the web into two or three part-webs, so that during the continuous or thrust-wise operation the web withdrawn from the coil will continuously be severed to the correct width. Further folding stations could possibly be arranged downstream of the knives, e.g. to impress edges of the pack.

There has so far been no mention of protecting the inside of the longitudinal seam. The station dealing with this may be located upstream of a direction changing roller which may be the last one before the jig mandrel. At this station a sealing strip is placed on what will later be the inside of the coated web of paper, in the region of the subsequent longitudinal seal, to prevent a surface which is uncoated because of the cut at the side edge of the web from coming to rest opposite the filling material, particularly the liquid. If this were not done the liquid could penetrate into the cut edge, unprotected by plastics, and soften up the pack there. Cover strips or sealing strips for the cut edge have therefore been provided here, so that the cut edge can also be covered with plastics and the above difficulties avoided. After this station the coated web of paper thus treated can desirably be guided through a direction changing roller, so that the fully prepared web can be taken to the jig mandrel described and also, coaxially and in alignment, to the outer shaping ring.

In a preferred embodiment of the pack making machine, the individual operations take place in stages, and consequently the web of paper and thus the tube are conveyed in stages or intermittently; for this reason one or two longitudinal sealing jaws are arranged movably. The longitudinal seam is sealed by this jaw or these jaws, engaging from outside onto the jig mandrel or shaping mandrel.

The sealing of the cut edge, so-called LS protection, can be effected not only by applying an appropriate cover strip as described above; it may alternatively take place later on the mandrel wheel, when the end wall which will later form the cover is moulded on. To enable the longitudinal seam to be correctly welded and the further operations to be correctly positioned, an annular stop is provided on a mandrel-shaped lower moulding tool component, and when the seam has been finished the length of tube is pushed against this stop which is slid down off the mandrel and transferred to the lower tool. It is brought thus into abutment by means of transporting jaws arranged downstream of the sealing jaw; one or more transporting jaws may be provided here, oscillating in time with the machine.

In accordance with the invention it is desirable for the conveyor to have two transporting jaws, arranged diametrically opposite outside the hollow jig mandrel, and midway between the jaws an inner member adapted to move in a longitudinal slot of the jig mandrel. In this way no disadvantageous friction mark forms on the outer wall of the pack, preferably the side wall, caused by traces of friction between transporting jaws and the side wall; this is because it is not such friction, but rather a clamping action, that is responsible for moving the tube forwards.

Behind the jig mandrel—in the direction in which the tube is conveyed—there is a cutter which, in a special embodiment of the invention, preferably has a rotating ring carrying cam-controlled blades which are distributed around the periphery. Thus the procedure followed by the pack making machine is for the longitudinal seam to be made first on the jig mandrel, and for the tube then to be moved on one length onto the mandrel wheel, so that the seam can cool and harden. In the course of this movement the foremost length but one is transferred from the jig mandrel to the lower tool component, over a gap where the cutter described is located. This is of course the last place where the tube can be separated or divided into individual lengths, since if it were not the mandrel-shaped lower tool component would not be able to move away by turning laterally out of the cnveyor on the mandrel wheel.

The rotatable mandrel wheel arranged adjacent the cutter has at least three and preferably eight radially projecting, mandrel shaped lower moulding tool components, arranged at an appropriate angular spacing from one another. The mandrel wheel turns in cadence, and the whole apparatus operates in cadence. When the mandrel wheel is turned through a specific angle, the length of tube described, which has been separated by the cutter, is moved below the moulding machine and in particular below the upper component of the moulding tool, so that the upper and lower components of the moulding machine are in exact alignment. In this state the end wall which will later form the cover can be moulded. These moulding operations are technically well understood, and particularly with the web of supporting material, i.e. the upper edge of the length of tube, being coated even if only thinly, the plastics material applied by the moulding machine forms an excellent bond, thus guaranteeing absolute imperviousness between the side wall and the cover of the subsequent pack.

The mandrel wheel and thus the length of tube in question move on intermittently, until the conveyor arranged preferably horizontally under the mandrel wheel is reached. This may be one of the known chain conveyors which offers sufficient rigidity and resistance to enable the stop described above, i.e. the ring movable relative to the mandrel-shaped lower tool components, to strip off the length of tube in question with the cover (which has hardened in the meantime) and to set it down firmly enough for all the parts projecting at the end of the tube, beyond the end line perpendicular to the axis of the tube, and in particular the opening device in the cover, to be pressed in to the transport shape. After the stripping operation the stripping ring, which was also a stop, moves over the mandrel-shaped lower tool component during the next intermittent turn towards the centre of the mandrel wheel, so that when the above-mentioned angular position is reached it can again act as a stop to arrest the next length of tube. In the meantime the pack, which is initially still upside down with the cover on the conveyor and the base uppermost and open, is brought by the conveyor, e.g. the so-called station chains, under a piston charger or the like in which the pack is filled with the material. For stabilisation and also shaping and to provide the requisite for the later shaping of the block base, shape carriers are provided on the conveyor. These are preferably open at the top and, in a further preferred embodiment, comprise at least two parts which are movable relative to one another. In accordance with the invention, when these parts are retracted they give a round cross-section at least in the region of one, lower end and a square cross-section at the other, upper end. This provides the prerequisite for shaping the block base and then welding it. The shape carriers are desirably arranged on the conveyor at a spacing from one another, so that they move with the conveyor and always stand in alignment below the mandrel-shaped lower tool components to receive the length of tube sealed at one end. Furthermore these shape carriers, together with the then open-topped packs, stand in alignment below the filling station and, an appropriate time later, under the various stations for sealing the end wall which later forms the base, for preparing the triangular flaps for application, and for heating the triangular flaps and also under the plunger for pressing down the corners.

A desirable embodiment of the apparatus operates at a two second cadence and has eight mandrel-shaped lower tool components distributed evenly around the periphery of the mandrel wheel. In this special preferred apparatus the axis of the jig mandrel is inclined 45° to the horizontal, the longitudinal axis of the moulding tool has an angular spacing of 45° from the jig mandrel, so that the upper and lower tool components are arranged substantially vertically below the moulding machine, and the newly moulded cover, after leaving the moulding machine, takes three operating cadences, i.e. three times two seconds, to progress from its next position, turned out of the moulding machine through 45°, to the stripping position and for the length of tube to be transferred to the open-topped shape carrier; that is to say, it takes six seconds altogether for the cover to cool.

Since some of the components of the above apparatus are known per se, it is possible to produce the apparatus for carrying out the method of the invention, using the know-how of the branch in question, without an excessively large outlay. Such an apparatus can therefore be constructed relatively quickly even with known plant, after appropriate conversion. Various units together form the apparatus, so that by exchanging one unit for an appropriate different one the whole apparatus becomes highly adaptable, e.g. to different shapes of desired packs, round, square, rectangular cross-sections and the like. The apparatus works satisfactorily with fairly thin paper, to produce a pack of the same stiffness.

The web of paper, i.e. the supporting material, need only be given a fairly thin coat of plastics, and the longitudinal welding and formation of the transverse seam are nevertheless guaranteed to be satisfactory; for block base welding is a dry type of weld. The tendency to have simple processing and a small number of components in the apparatus is encouraged if the web of material to be processed is pre-impressed during its manufacture. The coating of the web of supporting material with a fairly thin layer of plastics has the advantage of enabling the speed of the extruder to be increased. One can benefit from years of experience in making the material.

Figure 2:
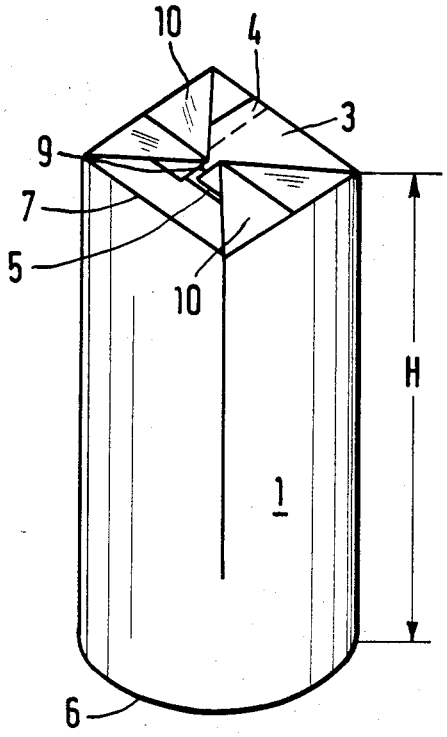
Figure 4:
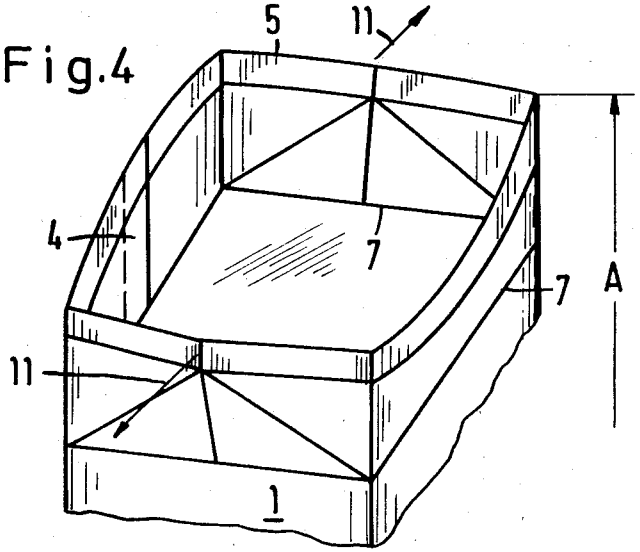
Figure 5:
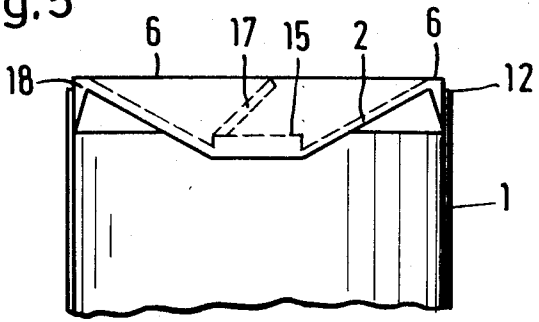
Figure 3:
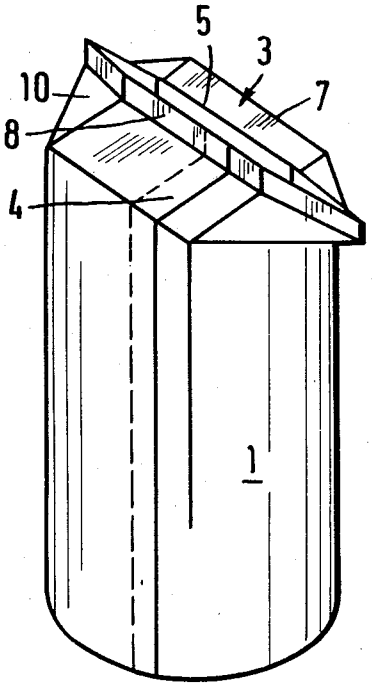
Figure 6:
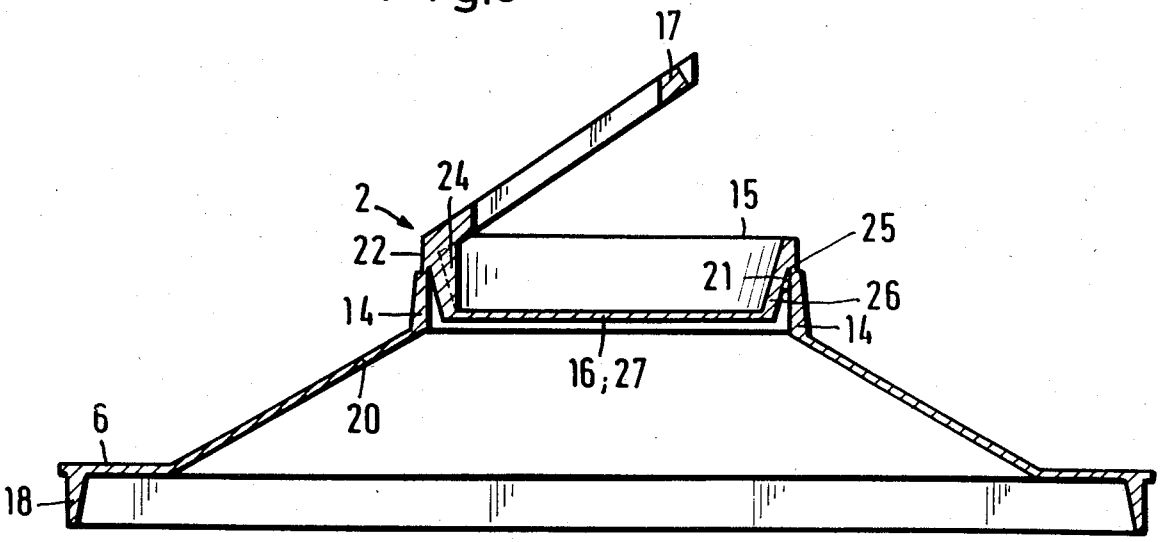
Figure 7:
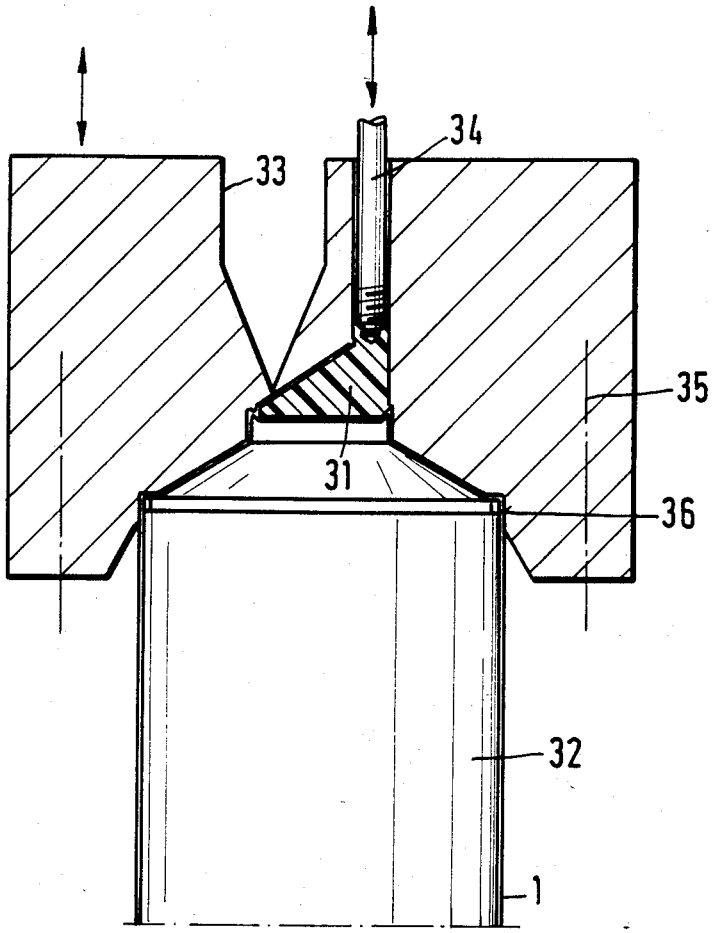
Figure 8:
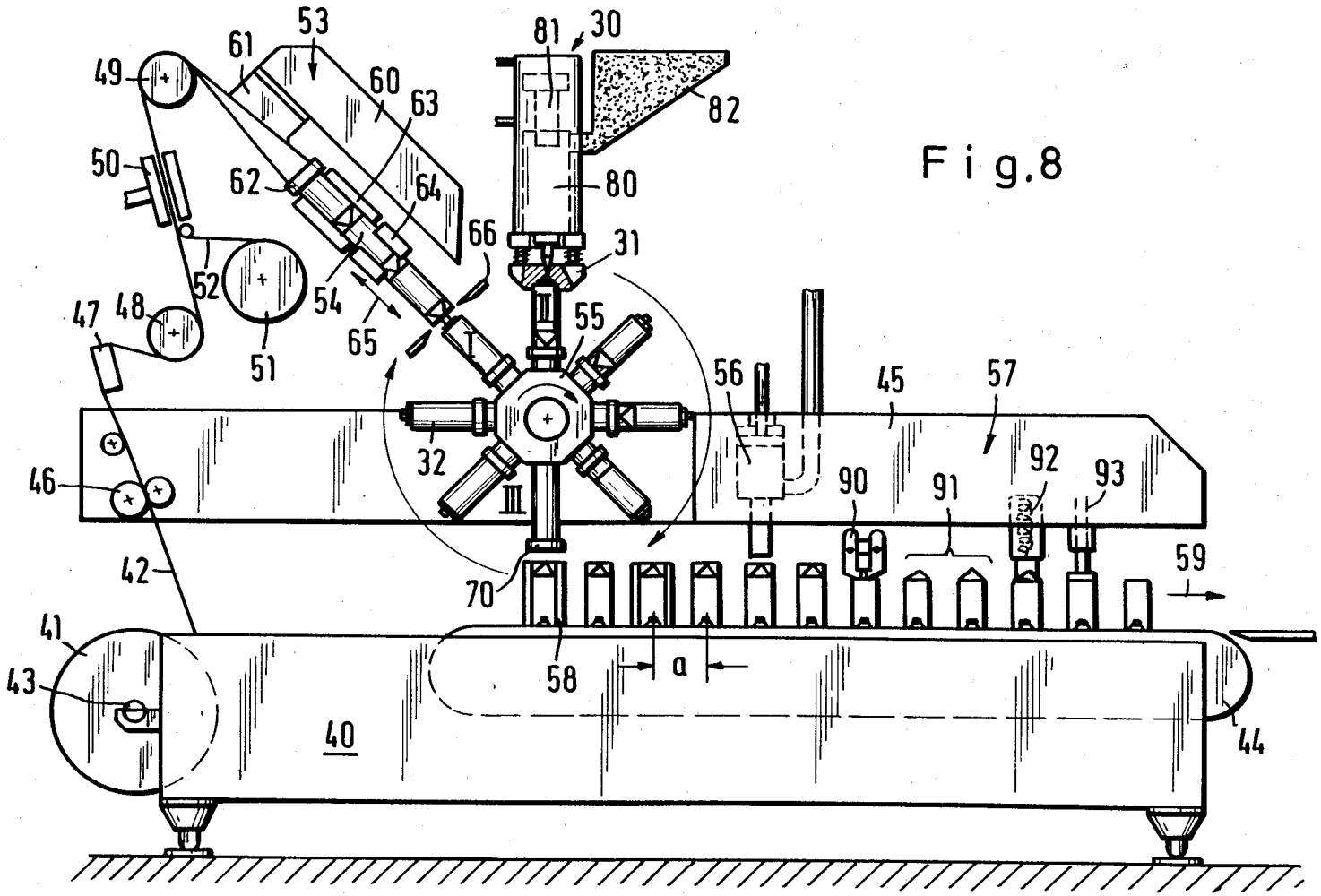

Other advantages, features and applications of the invention will emerge from the following description of a preferred embodiment. This refers to the accompanying drawings, in which:

FIG. 1 is a perspective view of the closed pack, ready for use, in a preferred embodiment of the invention, FIG. 2 is a perspective view of the same pack but bottom up, with the cover, which is here underneath and not visible, pressed in so that no parts of the opening device project from the lower edge of the cover beyond the overall contour of the pack, FIG. 3 is a perspective view of the base when the block base has been folded and before the transverse sealing seam has been made, FIG. 4 shows the top end of the pack with lines for forming the block base impressed in it, where the base will subsequently be formed by folding, FIG. 5 is a diagrammatic cross-sectional view of the cover in the state in which it is transported, with no parts of the opening device projecting beyond the overall contour of the pack, FIG. 6 is a sectional view through the ready-moulded cover, without the side walls, FIG. 7 is a section through the upper and lower tool component of the moulding machine (not shown) with the pack broken away, and FIG. 8 is a diagrammatic view of the overall construction of the apparatus for making the pack according to the invention.

The pack will first be described with reference to FIGS. 1 to 6, then the apparatus for making the pack with reference to FIGS. 7 and 8, and finally a possible mode of operation for the apparatus.

The finished pack for fluid filling materials shown in FIGS. 1 and 2 comprises side walls which are together defined as 1. This is because in this embodiment a round cross-section is provided in the region of the cover 2 (since the cover 2 is circular in plan), so that one could possibly distinguish between four side walls at the end forming the base 3. For the sake of simplicity the side walls will be referred to as 1 in this description. As shown in FIGS. 1 to 4 they are shaped into a tube and joined along the longitudinal sealing seam 4, thereby definitively forming the closed tube. It will be seen from FIG. 2 that the seam 4 extends into the base 3. This results from the blank used, as will also be seen from FIG. 4. In the FIG. 2 form the tube has a height H which (taking into account the shaping shown in FIG. 4 before the base 3 is finished) is clearly smaller than the length A of the section from the exposed upper edge 5 of the tube to the upper edge 6 of the cover 2.

The top edge of the finished pack is the line 7 shown in FIGS. 2 to 4. The various unspecified folding and impression lines shown in FIG. 4 form the double strip 8 of carton (FIG. 3) in the shaping of the block base; this strip contains the transverse seam 9 which is contained in FIG. 2 and hardly visible. The triangular flaps 10 are formed in the same process. The formulation of the base 3 progresses from the FIG. 4 state, through the FIG. 3 state to that shown in FIG. 2. The corners, which will later be the tips of the flaps 10, are first moved outwardly in the direction shown by the arrows 11 (FIG. 4), and pulled until the state shown in FIG. 3 is reached. The double carton strip 8 is pressed together, the seam 9 formed, and the triangular flaps 10 folded over onto the base and held there e.g. by spot heating, so that the state shown in FIG. 2 is reached.

This sealing of the base 3 takes place when the pack has been filled, as will be described below. In other words, the cover 2 has already had a fluid-tight seal formed in it at the end of the pack which is at the bottom in FIGS. 2 to 4. In contrast with the square base 3, the preferably—but not necessarily—round cover 2 in the new pack is made only of thermo-plastic material and constructed without any supporting material. The cover can therefore be moulded on along the outer edge 12 of the tube or side walls 1 (FIG. 5), in the form in which it will be used, as shown in FIG. 1. FIG. 5 on the other hand shows its shape during transport; the pouring device shown generally at 13 is pushed inwards, inside the outer contour of the pack, so that none of its component parts project beyond the outer edge 6. This gives perfect stability and satisfactory repacking (using sheets of shrink film or the like).

The pouring device 13 is seated in the middle of the cover 2. It is in the form of an upright annular collar 14 extending outwardly, i.e. upwardly in FIG. 1. Its upper edge 15 is joined to a stopper 16 with a gripping ring 17 welded onto it.

The exact shape when the cover 2 has been moulded can be seen clearly from FIG. 6. The top edge 6 of the cover 2 is virtually only a ring, with a wedge-shaped support 18 moulded onto the outside of it, so that the top of the tube or side wall 1 comes to rest below the edge 12 (FIG. 5) around the support 18. This provides a particularly strong and rigid connection between the cover 2 and the side wall 1. Between the outer edge of the cover and the collar 14 is a frustoconical surface 20. This extends outwardly in the state shown in FIGS. 1 and 6, i.e. in the form in which it is used, and inwardly at approximately the same angle in the form in which it is transported. At the top edge 15 of the collar 14 a line of weakness 22 is provided, in a circular shape apart from the point 21 shown at the right hand side of FIG. 6. This line forms a weak point extending round the stopper 16 through almost 360°, so that the stopper can easily be pulled out to open the pack. Beside the point 22 on the line of weakness (at the left hand side of FIG. 6) is the point 23 (FIG. 1) where the gripping ring 17 is connected, and adjacent the point 23 there is an arched portion 24. This projects from the collar 14, inwardly towards the centre, so that the wall of the arched portion 24 extends inwardly (FIG. 6) and is separated from the environment only by the line of weakness 22. When the user tears open the line of weakness 22 by pulling on the gripping ring 17 (upwards in FIG. 6), the line 22 breaks first in the region of the arched portion 24, so that air can advantageously enter the base below the cover 2.

The hinge 25 for the stopper 16 is provided diametrically opposite the arched portion 24, at the right hand side of the stopper 16 in FIG. 16, near the point 21. As indicated in FIG. 6 therefore, the stopper can be moved clockwise about the hinge 25, i.e. turned in the opening direction, without the stopper 16 being simultaneously torn off. This enables the container to be advantageously reclosed, since the stopper 16 has an edge 26 extending substantially parallel with the collar 14, and this edge is closed only by the flat base 27.

The apparatus for making the pack includes a moulding machine 30, which is shown as a detail in FIG. 8 and the upper component 31 and lower component 32 of which are shown on a larger scale and in section in FIG. 7. Familiarity with the cover shown in FIG. 6 makes the FIG. 7 embodiment easier to understand. The exact contour of the two inwardly facing surfaces of the upper and lower components 31, 32 is obtained by machining to match the shape of the cover 2, so it will be sufficient here to mention only a few parts: for example, the hopper 33 for injecting plastics into the cavity, the support 34 for the moulding plunger 35, and the forming and sealing members 36 to prevent the plastics material, preferably polyethylene, from being squeezed laterally outwards past the mandrel-shaped lower component 32 of the moulding tool. It will be clear from FIG. 7 that a lower moulding tool component 32 of one length may be replaced by one of a different length, without the cover 2 having to be differently shaped and the rest of the machine fitted with different parts.

The whole apparatus for making the pack described above can best be explained with reference to FIG. 8. At the left hand side of a frame 40 there is a coil 41 of carrier material 42 in web form, thinly coated on both sides with plastics, preferably polyethylene, and here rotatably mounted on bearings 43. An endless conveyor 44 is shown diagrammatically on the right hand upper half; this is provided with drives in known manner and may be a station chain conveyor. The upper and lower sides of the conveyor 44 are horizontal and some distance to the right of the coil of paper 41. Some distance above the frame 40 there is a support 45, on which cutters in the form of round knives 46, for separating the webs of carrier material 42, are rotatably mounted at the left hand side. 47 is a preliminary bending station for making the edges of the pack; behind this there is a first direction-changing roller 48, over which a second direction-changing roller 49 is located. Between the rollers there is a diagrammatically illustrated sealing jaw 50 with an unspecified backing member. A strip 52 of plastics withdrawn from a reel 51 is sealed up longitudinally over the cutting edge for LS protection by the jaw 50, so that no direct contact edge between paper and fluid is possible there when fluids are being packed.

The tube forming station 53, which will be described in greater detail below, is arranged between the last-mentioned LS sealing station 50–52 and the moulding machine 30 which is fixed to the support 45 at the right hand side. The essential component is the jig mandrel 54, which is covered by the tube illustrated and which is marked "54" at the place where it is arranged under the tube. The axis of the mandrel 54 is at 45° to the horizontal. In a continuation of the mandrel 54 downwards and to the right there is a mandrel wheel, shown generally at 55, with eight mandrel-shaped lower moulding tool components 32. To the right of the wheel 55 a piston charger 56 is provided on the support 45, and further to the right the block base welding station, referred to generally as 57, is shown diagrammatically.

Finally, a shape carrier 58 is indicated only at two positions on the upper side of the conveyor 44. It is arranged on the conveyor 44 at a spacing a from the adjacent shape carrier, and is moved forwards therewith below the block base welding and sealing station 57 in the direction of the arrow 59.

The tube shaping station 53 comprises a support 60, also at 45° to the horizontal, with the forming or jig mandrel 54 fixed to it by way of the mandrel curving portion 61. Below and to the right of the direction changing roller 49, the coated web of paper 42 is laid around the curving portion 61 in the form of a shell open at the bottom. The bottom right hand end of the shell is in contact with and under tension inside the outer ring 62, which is also coaxial with the mandrel 54. The transporting direction should here be thought of as running from the direction changing roller 49, downwards to the right at 45°, towards the mandrel wheel 55. Behind the outer ring 62 in the transporting direction a longitudinal sealing jaw 63 is provided, and a transporting jaw 64 some distance further in the same direction. The transporting jaw oscillates in time with the whole apparatus, in the direction of the double arrow 65. The mandrel 54 extends a further length A in the conveying direction, i.e. as far as the cutter 66. This is here indicated diagrammatically by two knives, but may in fact be a circular knife with a backing knife arranged inside it to exert a shearing action.

Functionally speaking the mandrel wheel 55 comes after the tube shaping station 53. It can move around the central spindle in the direction of the arrow, i.e. clockwise, and in time with the machine, i.e. intermittently, with each cycle advancing a mandrel-shaped tool component 32 45° clockwise. Each lower component 32 carries an annular abutment 70, which is driven so that it can make an oscillating movement to exert a wiping action, axially of the mandrel-shaped component 32. The abutment or wiper ring 70 is in its lowermost position when in the bottom position III.

Vertically above position III, i.e. in position II, the appropriate lower tool 32 is vertically below the moulding machine 30 as in the FIG. 7 arrangement. The upper tool 31 can move vertically up and down (so that it can be lifted off the lower tool 32 and release the cover 2 just moulded), with a stroke larger than the oscillation stroke of the injection cylinder 80 with the dosing plunger 81 and granulate container 82. A detailed description of the moulding machine 30 appears to be just as unnecessary here as one of the sealing station 57 with the means 90 for sealing the base, means 91 for preparing the triangular flaps 10 for application to the base 3, means 92 for heating the triangular flaps 10 and means 93 with the stamps for pressing down the flaps 10. The pack shown on top of the conveyor 44 is so to speak standing on its head; the cover 2 can be seen at the bottom, while the end wall which will later form the base 3 is at the top. For this reason, when the filled and sealed pack is taken away in the direction of the arrow 59, it is turned the right way up.

The machine operates as follows: The web of paper 42 is divided, e.g. by the roller blades 46, into three separate, adjacent webs, each of which is fed to the same apparatus as shown altogether in FIG. 8. However, it will be sufficient to describe the functioning of one machine in order to explain the operation and method of the invention. The web of paper 42 is prebent by the means 47, into the as yet not pre-impressed edges, after which it is diverted by the roller 48 and guided into the edge protecting station 50. Here the plastics strip 52 withdrawn from the reel 51 is sealed over the non-plastic coated cutting edge of the web 42 by the sealing jaw 50. The web of paper thus prepared is directed downwards to the right by the direction changing roller 49, so that the transporting direction is from the upper outer periphery of the roller 49, through the axis of the mandrel 54 towards the centre of the mandrel wheel 55. As a result of the tension generated by the transporting jaws 64, the web of paper 42 is first wrapped round the mandrel curving portion 61 41 in a semi-circle, like a shell open at the bottom, and then fully surrounds the jig mandrel 54 while lying against the inside of the outer ring 62. This surrounding action produces the tube shape and is such that the two free edges of the tube overlap some distance, so that the longitudinal seam 4 can be made at the overlap by means of the sealing jaws 63. The tube section of length A is stationary during the sealing process. When the sealing jaws 63 have opened, the transporting jaws 64 draw the next length of tube but one one length A towards the mandrel wheel 55, thereby bringing the length of tube in question, where the seam has just been made, to the right hand bottom end of the mandrel 54. Here it is severed by the cutter 66 from the part which has just been pushed over the lower tool 32 as far as the stop 70 by the above-mentioned action of the transporting jaws 64.

During the next step the length of tube in question is pushed past by the cutter 66 into position I on the mandrel-shaped lower tool 32. The lower tool 32 is approximately 0.5 mm smaller in diameter than the mandrel 54.

The mandrel wheel 55 now turns one step further, i.e. 45° clockwise, so that the length of tube in question reaches station II under the moulding machine 30. The upper tool 31 moves into the position shown in FIG. 7, engaging round the top edge of the tube or side wall 1. In this way the cover 2 is moulded directly onto the top edge 12 of the side walls 1. The upper tool 31 and the additional injection mandrel 35 then move away from the cover 2, and the mandrel wheel 55 can move through 180° to position III, the cover with the new moulding being cooled simultaneously.

The mandrel wheel 55 is so adjusted and synchronised with the other stations 53, 30 and the shape carrier 58 that exactly registering positions are obtained at the various stations, particularly stations I, II and III between the axes of opposed parts. In station III the annular stop 70 acts as a stripper and pushes the length of tube in question, which is sealed at one end by the cover 2, downwards towards the conveyor 44, into the shape carrier 58. In the FIG. 1 embodiment, i.e. with a round cover and square base, the carrier 58 is initially open to let through the cover 2 which projects further and has a larger area; it then closes over the smaller square surface. In pushing the cover down, the ring 70 pushes it onto the top of the conveyor 44, with the aid of the stiff side wall 1, in such a way that the cover 2 moves into the transporting shape shown in FIG. 5. This inward movement creates no difficulties since the pack is still empty.

The station chain conveyor 44 conveys the pack, still open at the top and ready for filling, and a shape carrier 58 takes up a position a distance a from the next. The pack passes under the filling station 56, in the form of a piston charger, and is filled to the top edge 7. In means 90 the base is closed from the state shown in FIG. 4 to that in FIG. 3. In the means shown diagrammatically at 91, after transverse sealing, the triangular flaps 10 are prepared for application; at station 92 they are heated, while means 93 attach them to the base 3 with a pressure plunger, to give the shape shown in FIG. 2.

The triangular flaps mentioned may be folded over onto the base itself or onto a side wall, depending on the construction of the block base closure.

On the opposite side is the cover made only of thermoplastic material; its collar may be circular, oval, polygonal or the like and stands upright facing outwards. With the frusto-conical shape of the cover shown in the figures it is desirable for the collar to be arranged in the centre. With differently shaped covers, however, the collar may perfectly well be arranged laterally or nearer to the edge, so that the pouring edge is nearer the edge of the cover when the fluid is poured out.

When the cover has been pushed in from the manufacturing and moulding shape to give the transporting shape, all parts of the opening device, including the gripping ring welded onto it, are preferably within the outer contour of the pack, since this gives an optimum shape for transport. The embodiment illustrated shows a gripping ring moulded onto the stopper and raised obliquely at 30°. However, in a particularly desirable embodiment (not shown) the gripping ring is moulded on, turned through 180°. In other words, the main plane in the gripping ring is parallel with the upper edge of the pack or parallel with the plane extending through the edge of the cover. The ring is nevertheless still in its transporting shape within the outer contour of the pack. The arrangement of the ring in the position turned through 180° out of the stopper is desirable because the moulds for making the cover can then be simpler.

It will be seen from the above that the choice of the shape of cover can be varied somewhat according to the moulding tool used. For example, the pouring aperture might be moulded onto a concertina-like or bellows-like device. The main point is the "below deck shape" for transporting the pack and the "above deck shape"for pouring. The invention enables many required opening arrangements to be obtained, particularly for covers made only of thermo-plastic material. It also enables the possibilities of cold bending to be exploited to give the cover a different shape, e.g. the optimum shape for transport and the optimum form for the pouring process. Here the term "cold bending" refers to pressing the cover into the transporting shape or pulling it out into the utilisation shape.

I claim:

1. An apparatus for making a container comprising tube forming, cover molding, container filling and base sealing stations, the tube forming station comprising means for forming fold impressions on a continuous web of container supporting material, means for shaping the continuous web of material into a strand of connected tubular container bodies with fold impressions, means for sealing the longitudinal edges of said strand, means for advancing the tubular strand and severing the strand into separate bodies of partially assembled containers with said fold impressions; the cover molding station comprising means for receiving and positioning severed tubular bodies from the tube forming station, said cover molding station including means for molding thermoplastic covers onto the tubular bodies and means for removing containers from the receiving and positioning means, said apparatus having means for receiving the covered containers from the cover molding station for filling at the filling station and means for sealing the container base at the base sealing station.

2. The apparatus of claim 1, including means for applying a thermoplastic layer onto the container supporting material prior to the tube forming station.

3. The apparatus of claim 1 wherein the web shaping means of the tube forming station includes a molding ring and a mandrel.

4. The apparatus of claim 3 wherein the sealing means of the tube forming station moves on the longitudinal axis of the mandrel.

5. The apparatus of claim 2 wherein the means for receiving and positioning the severed tubular bodies of the cover molding station comprises a rotatable wheel having a plurality molding dies for aligning said bodies with the cover molding means.

6. The apparatus of claim 5 including means for conveying the covered tubular bodies to the container filling and base sealing stations.

7. A method for making a container comprising a molded cover and a one-piece tubular body and base, which comprises the steps of forming fold impressions for forming the container base on a continuous web of thermoplastic coated supporting material, joining and sealing longitudinal edges of the web to form a strand of connected tubular bodies each with said fold impressions, severing the terminal tubular body with said fold impressions from the strand of connected tubular bodies to form a partially assembled one-piece container body with fold impressions for forming said base at a first end, and affixing the molded cover onto the edge of the tubular body at a second end.

8. The method of claim 7, including the step of molding the cover in situ onto the tubular body.

9. The method of claim 7 including the step of sealing the base of the container after filling.

10. The method of claim 7 wherein the one-piece tubular body and base are fabricated from thermoplastic coated paperboard and the cover is thermoplastic.

11. The method of claim 10 including the step of molding the cover onto the edge of the tubular body.

12. The method of claim 11 wherein the tubular body is at least partially cylindrically shaped.

13. The method of claim 11 wherein the tubular body of the container has a rectangular cross section in the region of the base and a round cross section in the region of the cover.

14. The method of claim 11 wherein the cover includes a pouring device which is recessed within the tubular body.

15. The method of claim 12 wherein the tubular body of the container has a square cross section in the region of the base.

16. The method of claim 14 wherein the pouring device includes gripping means to both lift and open the pouring device.

17. A method of making a container comprising a molded cover and a one-piece tubular body and base, which comprises the steps of forming fold impressions for forming the container base on a continuous web of paperboard coated on at least one surface with a thermoplastic material, joining longitudinal edges of the web to form a strand of connected tubular bodies each with said fold impressions, severing the terminal tubular body with the fold impressions from the strand of connected tubular bodies to form a partially assembled one-piece container body with said fold impressions for forming the base at a first end, and molding a thermoplastic cover onto the edge of the tubular body at a second end.

18. The method of claim 17 including the step of providing a cover with a pouring device which is recessed within the tubular body.

19. The method of claim 17 wherein the tubular body of the container has a rectangular cross section in the region of the base and a round cross section in the region of the cover.

20. The method of claim 19 wherein the tubular body of the container has a square cross section in the region of the base.

21. The method of claim 17 including the step of sealing the base without sealing the body to the base along the edges of the base.

22. The method of claim 18 including the step of providing the cover with gripping means to both lift and open the pouring device.

* * * * *